US008627513B2

(12) United States Patent
Colbert

(10) Patent No.: US 8,627,513 B2
(45) Date of Patent: Jan. 14, 2014

(54) PRAYER BREASTPLATE

(76) Inventor: Bettie A. Colbert, Novi, MI (US)

( * ) Notice: Subject to any disclaimer, the term of this patent is extended or adjusted under 35 U.S.C. 154(b) by 256 days.

(21) Appl. No.: 13/103,371

(22) Filed: May 9, 2011

(65) Prior Publication Data

US 2011/0271417 A1 Nov. 10, 2011

Related U.S. Application Data

(60) Provisional application No. 61/332,371, filed on May 7, 2010.

(51) Int. Cl.
*A41D 13/00* (2006.01)

(52) U.S. Cl.
USPC ..... 2/69

(58) Field of Classification Search
USPC ..... 2/69, 247, 94, 115, 108, 102
See application file for complete search history.

(56) References Cited

U.S. PATENT DOCUMENTS

| | | | | | |
|---|---|---|---|---|---|
| 3,055,133 | A * | 9/1962 | Anderson | 40/586 |
| 3,624,686 | A * | 11/1971 | Beals | 434/98 |
| 4,243,340 | A * | 1/1981 | MacGregor | 40/312 |
| 4,309,784 | A * | 1/1982 | Cohen | 5/639 |
| 4,912,780 | A | 4/1990 | Falack | |
| 4,924,613 | A * | 5/1990 | Levin | 40/586 |
| 5,173,968 | A * | 12/1992 | Fox | 2/244 |
| 5,632,044 | A * | 5/1997 | Sloot | 2/102 |
| 6,193,034 | B1 * | 2/2001 | Fournier | 190/107 |
| 6,209,134 | B1 | 4/2001 | Schiesel | |
| D456,116 | S * | 4/2002 | Cunningham | D2/854 |
| D489,512 | S | 5/2004 | McDonald et al. | |
| 7,334,269 | B2 | 2/2008 | Segol | |
| 7,454,856 | B2 * | 11/2008 | Passman | 40/661.04 |
| D621,588 | S | 8/2010 | Hamilton et al. | |
| 2003/0163861 | A1 | 9/2003 | Avrahami | |

FOREIGN PATENT DOCUMENTS

| | | | |
|---|---|---|---|
| JP | 09195107 | A | 7/1997 |

* cited by examiner

*Primary Examiner* — Tejash Patel
(74) *Attorney, Agent, or Firm* — Gifford, Krass, Sprinkle, Anderson & Citkowski, P.C.; Douglas J. McEvoy

(57) ABSTRACT

A fabric prayer breastplate includes a body exhibiting a substantially planar rectangular shape and with a plurality of individual representations of the twelve stones on Aaron's breastplate depicted on a surface of said body and which are representative of religious symbology, such as the twelve tribes of Israel in biblical Old Testament teachings. The individual representations include at least one of item supporting pockets, individually stitched panels or a single graphical depiction.

5 Claims, 6 Drawing Sheets

PRAYER BREASTPLATE

CROSS-REFERENCE TO RELATED APPLICATIONS

This Application claims the benefit of U.S. Provisional Application 61/332,371 filed on May 7, 2010.

FIELD OF THE INVENTION

The present invention relates generally to a fabric prayer breastplate garment used in religious practice or symbology. More specifically, the present invention discloses fabric prayer breastplate designs, each of which exhibiting a plurality of twelve colored patches or pockets and which are intended to be representative of the twelve stones representing the twelve tribes of Israel as depicted on Aaron's breastplate in biblical Old Testament teachings.

BACKGROUND OF THE INVENTION

The present invention is well documented with items of religious symbology, such as associated with Christian religion. The Breastplate of Aaron is of interest because it is an early accounting of the use of gemstones as both decoration and symbol. As a historical aside, Aaron is the brother to Moses and the leader of the tribe which is appointed as high priests.

The breastplate is described (Exodus 28:15-20 in the Bible) as the "Breastplate of Judgment" or "Breastplate of Decision" (dependent on the biblical translation) and is adorned with twelve gems—one for each of the 12 tribes of Israel. The gemstones were to be attached in four rows of three and each gem was to have the name of a tribe inscribed upon it.

SUMMARY OF THE INVENTION

The present invention discloses a fabric prayer breastplate design of a construction not previously known in the prior art which includes a body exhibiting a substantially planar rectangular shape and with a plurality of individual representations of the twelve stones on Aaron's breastplate depicted on a surface of said body and which are representative of religious symbology, such as the twelve tribes of Israel in biblical Old Testament teachings. The individual representations include at least one of item supporting pockets, individually stitched panels or a single graphical depiction.

The body further may further include first and second layers establishing an inner accessible pocket. A plurality of pockets can further be defined on a first side of the body, with at least one of a single graphical representation or plurality of representations established along a second side of the body. The body may also exhibit a colored trim extending along three exterior sides. The body may further include opposite edge extending ties.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

As previously described, the present invention discloses a religious fabric prayer breastplate design, variations of which exhibit a plurality of twelve colored patches, sewn panels or pockets, combined with a like plurality of patches or sewn panels (or single graphical representation including twelve individual colored sections) exhibited on a turned over side of the breastplate. The breastplate may further include a pair of layers joined along three interconnecting sides and further including a fourth (top) open side which defines a center pocket which can be used for larger lists or other documents. In use, the breastplate colors are intended to represent the twelve stones representing the twelve tribes of Israel as depicted on Aaron's breastplate in biblical Old Testament teachings.

Figure 1:
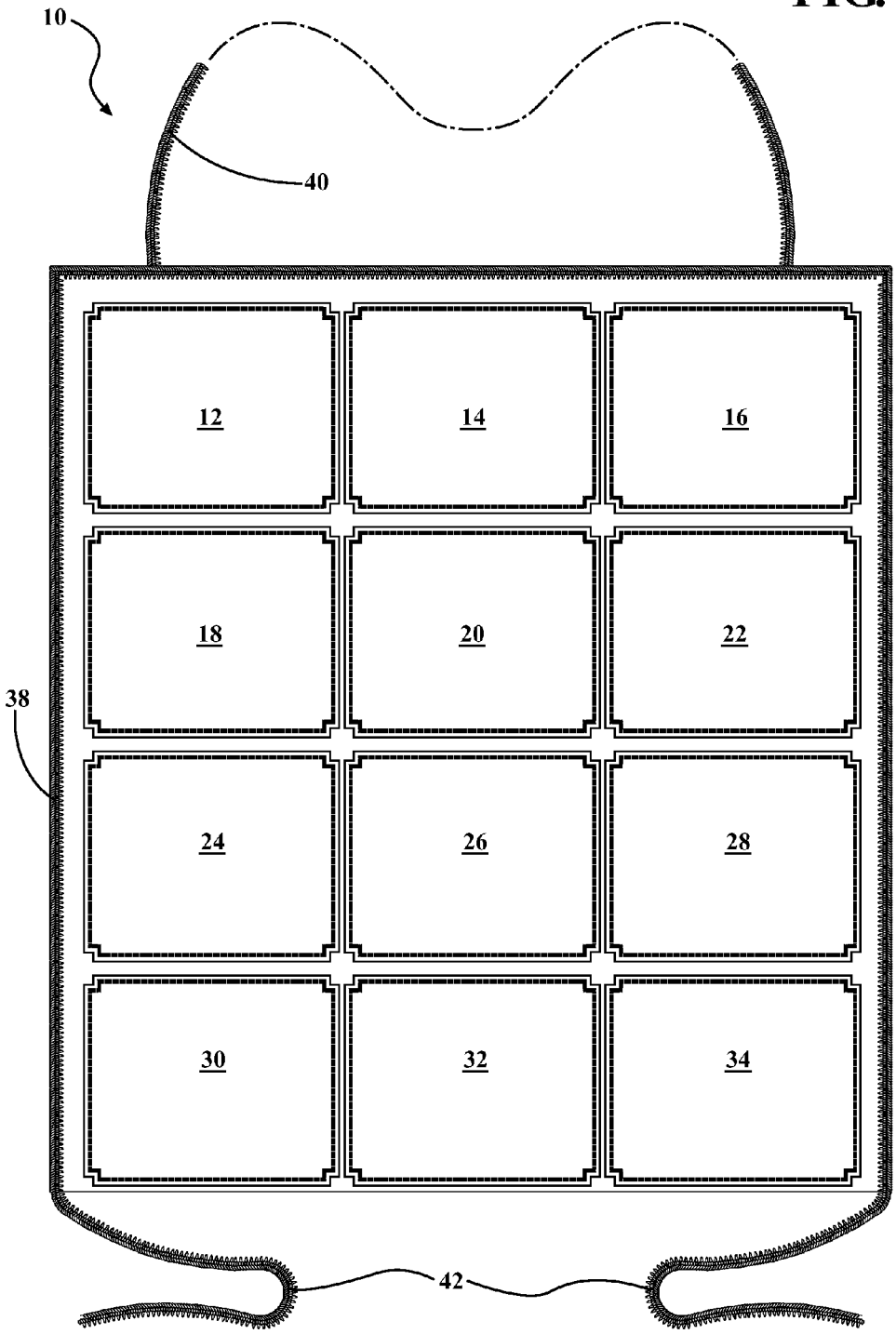
FIG. 1 is a plan view illustration of a fabric breastplate design in which one piece of material is folded in half and stitched along two sides (left and right) leaving the top unstitched to exhibit a center inner pocket. According to this embodiment, there are twelve individual color pockets located on the front panel. Three sides (top, left and right) are trimmed.

FIG. 1 is a plan view illustration at 10 of a fabric breastplate (Aaron's breastplate) design according to one embodiment of the invention. Although not limited to a specific overall configuration, the breastplate 10 typically exhibits a generally rectangular and planar shaped fabric article and as noted above being further understood in selected variants to include a pair of layers joined along three sides in order to define a central pocket. A first exterior face of the breastplate exhibits a plurality of twelve individual pockets corresponding to twelve individually colored and shaped portions, enumerated in FIG. 1 at 12-34 and which are designed for holding such as individual slips of paper with names written on them for prayer.

The overall shape of the garment 10, as well as that of the individual colored pockets 12-34 can be altered without departing from the scope of the invention. The garment 10 is further depicted with colored trim 38 extending along all four sides and also includes opposite edge extending pairs of handles 40 and 42.

Figure 4:
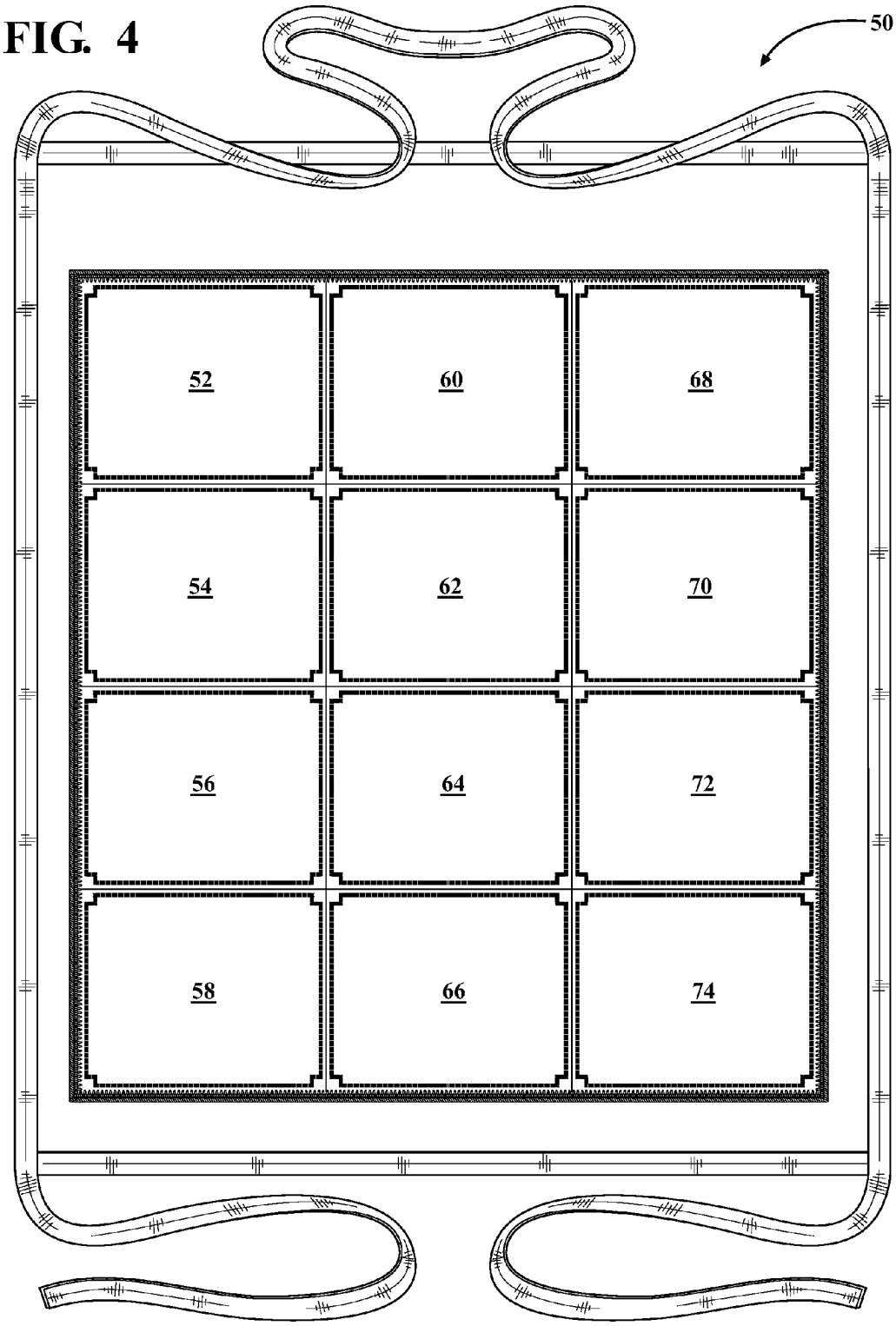
FIG. 4 is an illustration of a fabric prayer breastplate according to another embodiment in which twelve color patterns are designated in one graphic depiction, this variant exhibiting a plurality of twelve individual pockets on a reverse face and further combined with a large center pocket defined between the two layers making up the breastplate and which are joined along three interconnecting edges.

FIG. 4 depicts a fabric prayer breastplate 50 constructed of a fabric material and with twelve color patterns 52-74 shown as one graphical or pictorial representation, an opposite side of which again showing twelve individual pockets, combined with one center defined pocket. It is understood that the trim shown in the variants set forth in each of FIGS. 1 and 4 can extend along three interconnected sides (FIG. 1) or all four sides (FIG. 4) of the body. It is further understood that the trim can be modified from that shown in any of the drawings and without departing from the scope of the invention.

Figure 2:
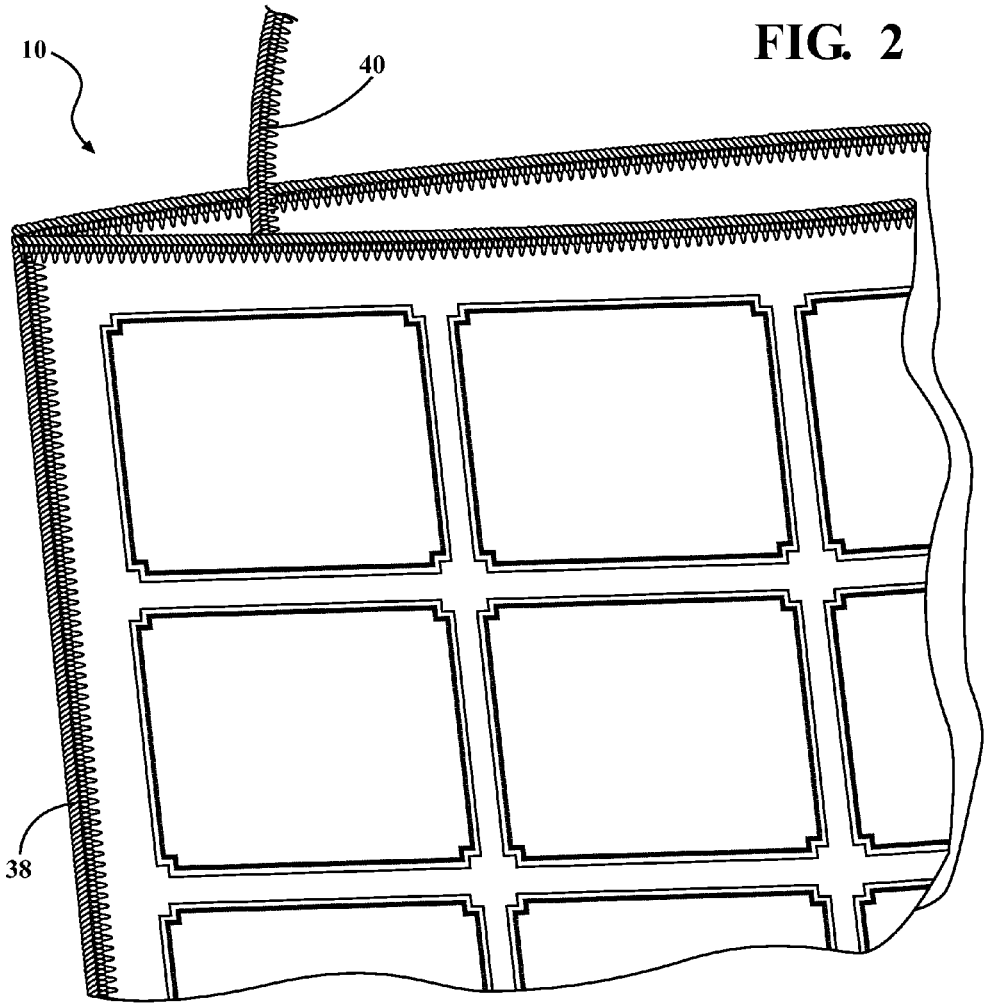
FIG. 2 is a further enlarged plan view of the front face design shown in FIG. 1 and which better illustrates the features of the design.
Figure 3:
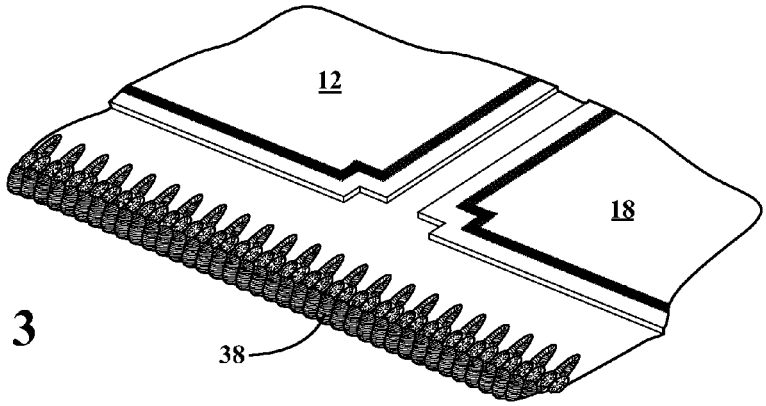
FIG. 3 is an enlarged sectional illustration of a stitched pattern such as is shown in FIG. 1.
Figure 5:
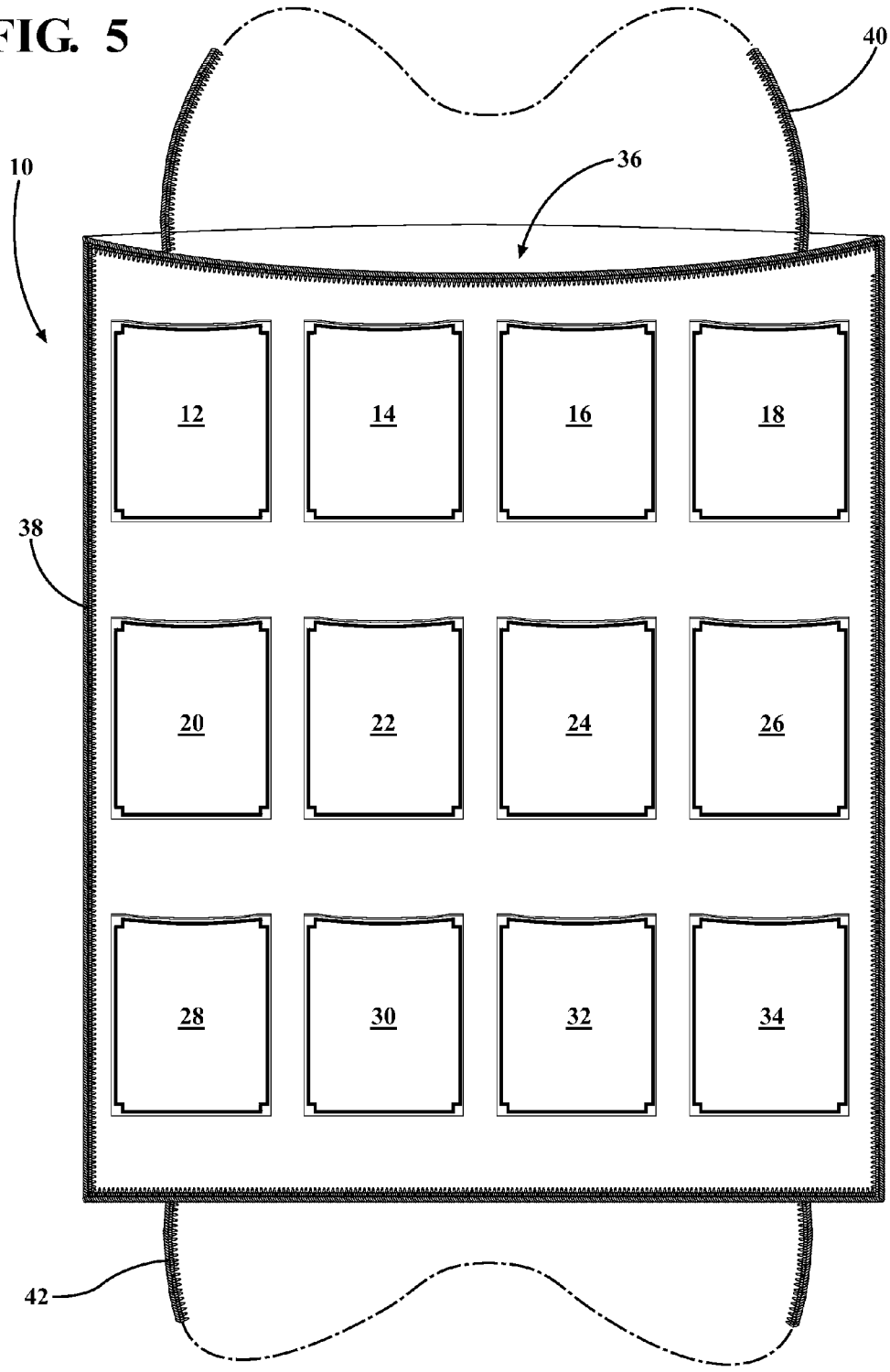
FIG. 5 is a further graphical representation of a fabric prayer breastplate such as depicted in FIGS. 1 and 2, and further in which the pocket pattern is depicted four across and three down according to one alternate application.

FIG. 5 is a further graphical representation of a fabric prayer breastplate 10, such as depicted in FIGS. 1 and 2, and further in which the pocket pattern is depicted four across and three down according to one alternate application.

Figure 6:
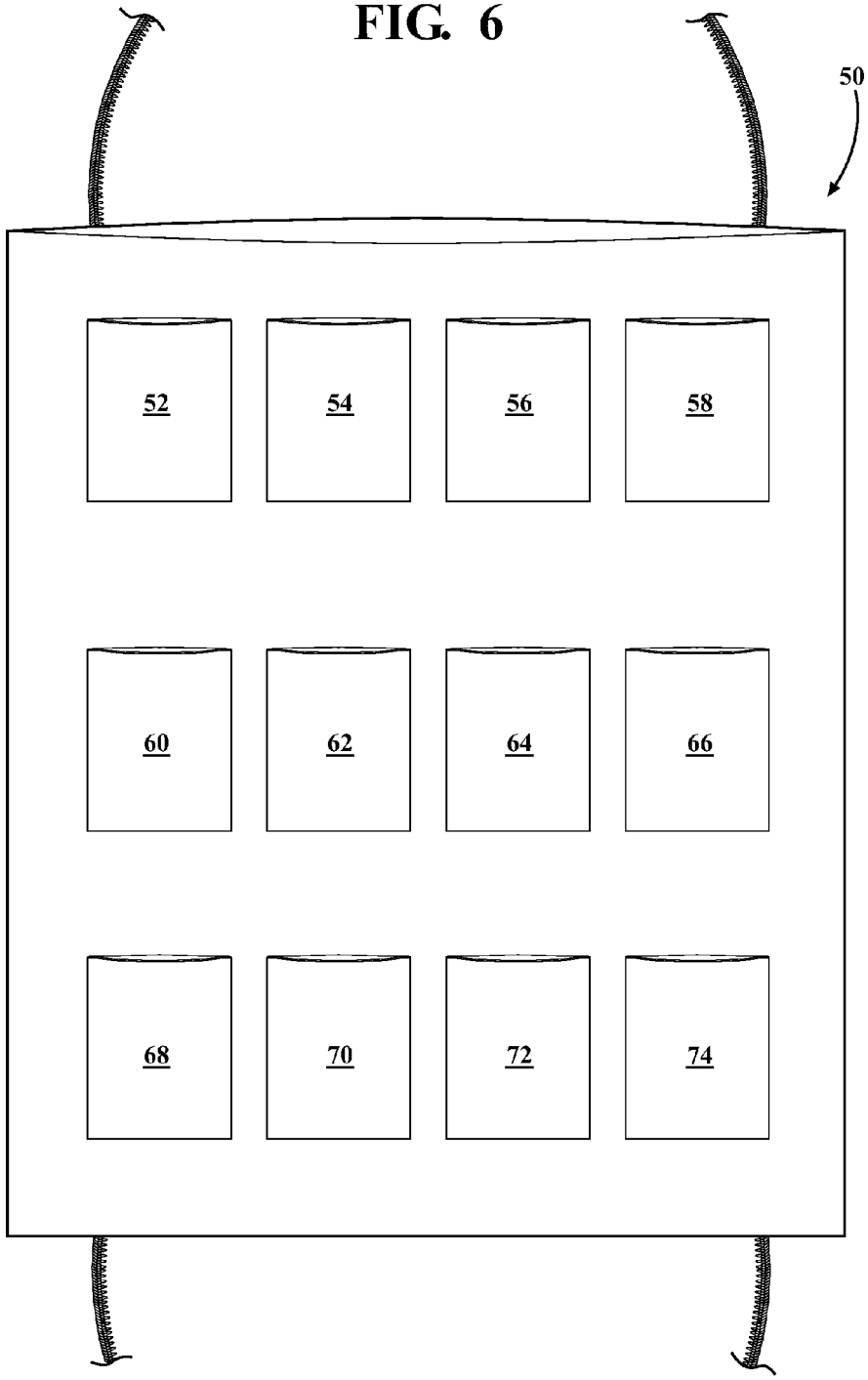
FIG. 6 is another graphical representation of a fabric prayer breastplate similar to that shown in FIG. 4 with individual pockets on a back side and a graphic picture illustration on the front in which the pockets are arranged four across and three down.
Figure 6A:
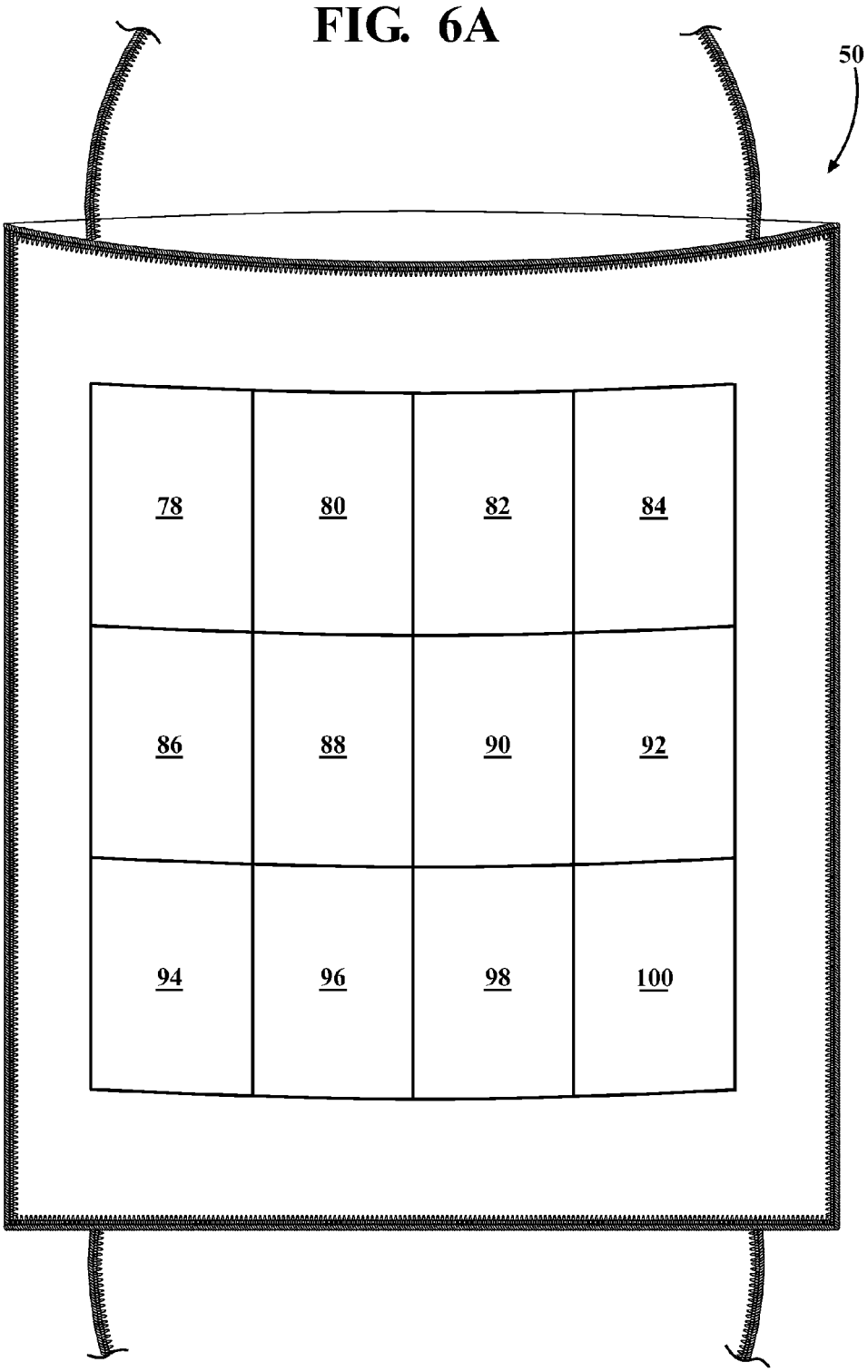
FIG. 6A is a turned over illustration of the fabric prayer breastplate in FIG. 6 and illustrating a reverse face exhibiting plurality of a dozen colored patterns according to the single graphic illustration.

FIG. 6 is another variant incorporating the pocket structure in which pockets 52-74 are shown arranged four across and three down. FIG. 6A exhibits another variant of the breastplate as generally shown in FIG. 4, in which the graphic shown includes a plurality of colored depictions 78-100 arranged four across and three down as again defined between the pairs of extending straps.

Having described my invention, other and additional embodiments will become apparent to those skilled in the art to which it pertains, and without deviation from the scope of the appended claims.

I claim:

1. A wearable fabric prayer breastplate, comprising:

a body exhibiting a substantially planar rectangular shape, said body further having first and second layers interconnecting along three outer perimeter edges of said body and establishing an inner accessible pocket;

a looped portion extending from upper edges of said body and adapted to fitting about a neck of a wearer;

a pair of elongated ties extending from lower edges of said body and adapted to tying about a midsection of the wearer; and a plurality of individual representations depicted on a surface of a first selected layer of said body and which are representative of religious symbology.

2. The breastplate as described in claim 1, said body exhibiting a plurality of twelve individually colored pockets representative of the twelve stones on Aaron's Breastplate, representing the twelve tribes of Israel in biblical Old Testament teachings.

3. The breastplate as described in claim 2, said individual representations including at least one of item supporting pockets, individually stitched panels or a single graphical depiction.

4. The breastplate as described in claim 2, further comprising a plurality of pockets defined on a first side of said body, at least one of a single graphical representation or plurality of representations established along a second side of said body.

5. The breastplate as described in claim 1, said body further comprising a colored trim extending along three exterior sides.

* * * * *